United States Patent [19]

Forth

[11] 4,408,469

[45] Oct. 11, 1983

[54] REFRIGERATOR CRYOSTAT

[75] Inventor: Hans-Joachim Forth, Cologne, Fed. Rep. of Germany

[73] Assignee: Leybold Heraeus GmbH, Cologne, Fed. Rep. of Germany

[21] Appl. No.: 328,152

[22] Filed: Dec. 7, 1981

[30] Foreign Application Priority Data

Dec. 10, 1980 [DE] Fed. Rep. of Germany ..... 3046458

[51] Int. Cl.[3] ..... F25B 19/00

[52] U.S. Cl. ..... 62/514 R; 62/55.5; 62/268; 55/269

[58] Field of Search ..... 62/100, 268, 55.5, 514 R; 55/269; 417/901

[56] References Cited

U.S. PATENT DOCUMENTS 4,150,549 4/1979 Longsworth ..... 62/55.5
4,266,959 5/1981 Welch ..... 62/55.5
4,295,338 10/1981 Welch ..... 62/55.5
4,311,018 1/1982 Welch ..... 62/55.5

*Primary Examiner*—Ronald C. Capossela
*Attorney, Agent, or Firm*—Felfe & Lynch

[57] ABSTRACT

A refrigerator cryostat for producing high vacuums at controlled temperatures in a sample chamber has first and second refrigerator stages for progressively lowering the refrigerator temperature to the sample chamber. An independent heater heats the sample chamber to provide, in combination with the refrigerator temperature, the controlled temperatures to the sample chamber. A vacuum pump preliminarily evacuates a casing about the refrigerator stages which is also in vacuum communication with the sample chamber, but a pumping surface in thermal communication with the first refrigerator stage and in the casing cryogenically augments the preliminary evacuation to the high vacuum levels necessary for operation of the refrigerator cryostat at sample chamber temperatures of, for example, from about 10° K. to about 350° K.

6 Claims, 2 Drawing Figures

REFRIGERATOR CRYOSTAT

The invention relates to a refrigerator cryostat which itself produces in a sample chamber both a high vacuum and any desired temperature in the range from, for example, approximately 10 K. to 350 K.

It is becoming increasingly common to use refrigerators for the production of low temperatures. Refrigerators are temperature reducing machines having at least one piston and one cylinder. The cylinder is connected alternately to a high-pressure and to a low-pressure gas source in a particular manner such that, during the reciprocating movement of the piston, a thermodynamic circulation process (Stirling process, Gifford-McMahon process, etc.) is performed in which the working gas can be carried in a closed circuit. The result is that heat is withdrawn from a certain part of the cylinder. With two-stage refrigerators of this kind, using helium as the working gas, it is possible to produce, for example, temperatures down to less than 10 K.

In known cryostats using two-stage helium refrigerators, the second stage of the refrigerator's cold head cools the sample and the first stage cools a radiation guard zone which surrounds the second stage with the sample mounted in it, doing so as completely as possible. The repeatable production of any temperature in the range from 10 K. to about 350 K. on the sample is achieved by corresponding electrical heating of the sample chamber of the second stage.

In order to reach the lowest temperature obtainable with a refrigerator, which is less than 10 K., the pressure in the casing of the cryostat must be less than $10^{-3}$ mbar. To produce and sustain this insulating vacuum, a high-vacuum pump (diffusion pump, turbomolecular pump or sputter-ion pump) has been used. For the operation of these pumps, fore pumps (preliminary evacuation pumps) are indispensable. The resulting relatively high investment in equipment for the production of the vacuum in the cryostat casing is necessary also for preventing gases evaporating at higher temperatures from the sample and/or from the second stage of the refrigerator from being redeposited on the sample and contaminating it when the temperature of the sample is lowered again.

It is therefore the object of the present invention to create a refrigerator cryostat having a two-stage refrigerator in which no expensive system is needed for the production of an insulating vacuum which also avoids the danger of contamination of the sample.

This object is achieved in accordance with the invention by the fact that the first stage of the refrigerator is equipped with a pumping surface. This pumping surface acts as a condensation cryopump and/or as a cryosorption pump, so that the external high-vacuum pump can be eliminated. All that is necessary is for a mechanical vacuum pump to be present for the preliminary evacuation. It is desirable for the second refrigerator stage to serve for the mounting of the sample and for the establishment of variable low temperatures. The first stage of a refrigerator as a rule assumes during operation a temperature of 40 to 60 K., which remains substantially constant, and it does this independently of the temperature of the second stage. At this temperature, gases such as $CH_4$, $N_2$ etc., can be bound to the pumping surface of the cryostat by sorption. Pressures in the $10^{-5}$ mbar range can thus be sustained.

Figure 1:
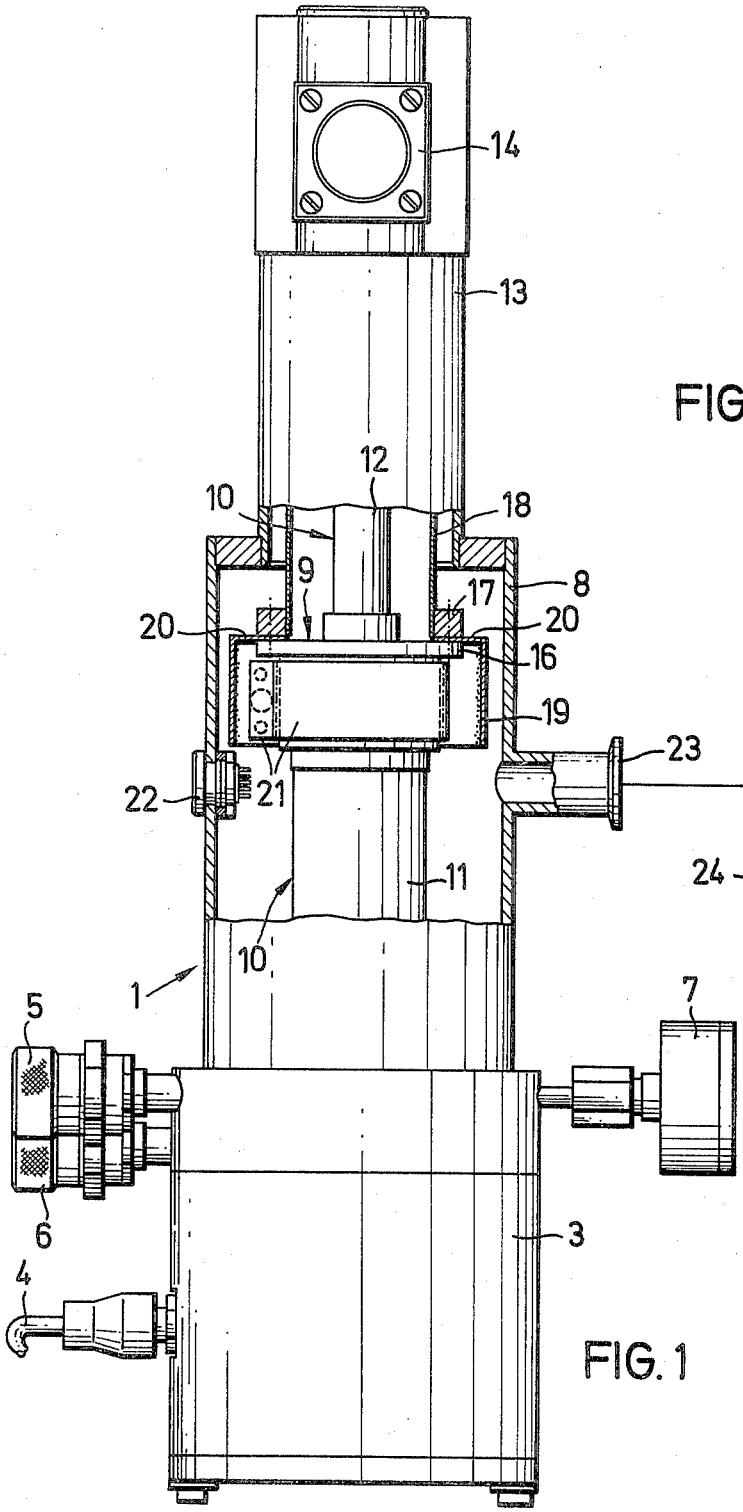
FIG. 1 is an elevation partly cut away and partly in section of a preferred embodiment.

Additional advantages and details of the invention will be explained with the aid of an embodiment represented in the drawing. A refrigerator cryostat 1 using a two-stage refrigerator and contained in a casing has been selected as the embodiment. In the lower part 3 of the casing, known means for powering the refrigerator cold head are contained in a manner which is not represented. Its power supply is delivered through the connecting cable 4. On the lower part 3 of the casing, the working gas inlet and outlet connections 5 and 6 are also provided. Lastly, the lower part of the casing bears a gauge 7 to indicate the temperature of the second stage. The actual two-stage cold head 10 of the refrigerator is located in housing parts 8 and 13.

In the middle part of the housing, indicated at 8, is the first stage 9 of the cold head 10 of the refrigerator. This portion of the embodiment is shown cut away. Consequently the cylindrical sections 11 and 12 of the cold head 10 of the refrigerator are visible, in which the displacers of the first and second stage of the two-stage refrigerator are located. The upper part 13 of the cryostat casing is again shown closed. In this area is located the second stage of the refrigerator, on which the sample is mounted in a known, chamber manner, which is not illustrated. At the level of the specimen the casing part 13 is provided with removable windows 14, so that the sample can be observed from one side.

The visible first stage 9 of the refrigerator has a flange 16 on which there is fastened an additional flange 17 which bears a cylindrical shield 18 for the sample. In addition, the first stage 9 of the refrigerator is equipped with a pumping surface 19 which consists substantially of a cylindrically shaped piece of copper plate, which is also fastened to the flange 16 by four bent-down tabs 20, so that there is good thermal contact with the first stage. The pumping surface 19 is coated with a highly polished nickel plating, and on the inside, facing the first stage, it is coated with several grams of active carbon. When the first stage is chilled, the outside of the copper serves as a condensation cryopump and the inside as a cryosorption pump.

Figure 2:
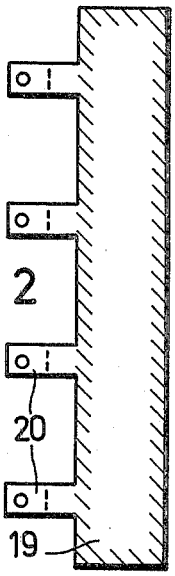
FIG. 2 is a plan view of a member shown in FIG. 1 prior to its assembly.

In FIG. 2, the pumping surface 19 is shown in unrolled form. The metal is coated on one side with active carbon. The length of the tabs 20 is selected such that openings are present between the outer margin of flange 16 and the cylindrical section, for the passage of the gases.

The first stage 9 of the refrigerator is also equipped with a heating sleeve 21. This heater is turned on only when regeneration of the sorption surfaces is required.

The input of the heating energy is accomplished in a manner not shown in detail through a vacuum-tight electrical lead-through marked 22. Through this lead-through, the second stage, which is not visible, is supplied in a known manner with heating current for the purpose of adjusting the temperature of the sample to the desired levels.

On account of the presence of the sorption surfaces 19 in the vicinity of the first stage 9 of the refrigerator, it is sufficient simply to connect the connection 23 on the middle part 8 of the casting to a vacuum fore pump 24. This pump serves only for the preliminary evacuation of the casing before and during the temperature-reducing action of the refrigerator. It can be separated from the casting if, after the chilling of the cold head of the refrigerator, the pressure drops below approximately $10^{-2}$ mbar. The sorption surface 19 accordingly brings it about that pressures in the range of $10^{-5}$ mbar can be produced and sustained. Even if higher temperatures of up to 350 K are established in the second stage, the pressure in the casing still remains at sufficiently low levels. How long this pressure can be sustained depends on the capacity of the active carbon. The capacity of about 5 to 10 g of active carbon suffices for an experiment extending over several days, and only then will it have to be subjected to regeneration.

We claim:

1. In a refrigerator cryostat system for providing high vacuums at controlled temperatures in a sample chamber thereof, the system comprising a cryostat having a casing, an opening into the casing only for preliminarily evacuating the casing, first and second refrigerator stages in the casing for producing progressively lower temperatures, a sample chamber in thermal communication with the second refrigerator stage and vacuum communication with the casing, and heating means independent of the second refrigerator stage for variably heating the sample chamber, whereby, between the second refrigerator stage and the heating means, the temperature of the sample chamber may be controlled in a range of, for example, from about 10° K. to about 350° K., the temperature of the first refrigerator stage being substantially constant and independent thereof, the improvement comprising:

a pumping surface (19) inside the casing and in thermal communication with the first refrigerator stage for cryogenically augmenting the preliminary evacuation of the casing during operation of the first refrigerator stage.

2. Refrigerator cryostat of claim 1, wherein the pumping surface (19) is formed by the cylindrically shaped piece of sheet metal.

3. Refrigerator cryostat of claim 2, wherein bent-down tabs (20) on the pumping surface (19) join it to the first refrigerator compressor stage.

4. Refrigerator cryostat of claim 2 or 3, wherein the pumping surface (19) comprises a copper plate having a highly polished nickel plated surface and an opposite surface coated with active carbon.

5. Refrigerator cryostat of claim 4, and further comprising a heating device (21) in the area of the pumping surface (19) whereby the pumping surface can be regenerated between operations of the cryostat.

6. Refrigerator cryostat of claim 2, 3, or 1, and further comprising a heating device (21) in the area of the pumping surface (19) whereby the pumping surface can be regenerated between operations of the cryostat.

* * * * *
* * * * *